US009673584B1

(12) United States Patent
Nelson

(10) Patent No.: US 9,673,584 B1
(45) Date of Patent: Jun. 6, 2017

(54) SYSTEM FOR EXTENDING ELECTRICAL OUTLETS

(71) Applicant: Josh Nelson, Frisco, TX (US)

(72) Inventor: Josh Nelson, Frisco, TX (US)

( * ) Notice: Subject to any disclaimer, the term of this patent is extended or adjusted under 35 U.S.C. 154(b) by 0 days.

(21) Appl. No.: 14/994,482

(22) Filed: Jan. 13, 2016

Related U.S. Application Data

(60) Provisional application No. 62/103,445, filed on Jan. 14, 2015.

(51) Int. Cl.

| | |
|---|---|
| ***H01R 4/66*** | (2006.01) |
| ***H01R 27/02*** | (2006.01) |
| ***H01R 13/717*** | (2006.01) |
| ***H01R 13/639*** | (2006.01) |
| ***H01R 13/70*** | (2006.01) |

(52) U.S. Cl.
CPC ..... *H01R 27/02* (2013.01); *H01R 13/639* (2013.01); *H01R 13/70* (2013.01); *H01R 13/717* (2013.01)

(58) Field of Classification Search
CPC .... H01R 13/652; H01R 31/02; H01R 25/006; H01R 31/06; H01R 29/00
USPC ..... 439/106, 651, 105, 650, 956
See application file for complete search history.

(56) References Cited

U.S. PATENT DOCUMENTS

| | | | | |
|---|---|---|---|---|
| 8,021,183 | B2 * | 9/2011 | Early | H01R 13/665 439/382 |
| 8,152,570 | B2 * | 4/2012 | Kim | H01R 13/506 439/680 |
| 8,215,009 | B2 * | 7/2012 | Early | H01R 13/665 29/838 |
| 8,480,410 | B2 * | 7/2013 | Early | H01R 13/665 439/620.21 |

* cited by examiner

*Primary Examiner* — Phuongchi T Nguyen
(74) *Attorney, Agent, or Firm* — Richard G. Eldredge

(57) ABSTRACT

An electrical cord system includes a male plug assembly configured to engage with a wall outlet, an electrical cord conductively coupled to the first male plug connector and the female plug connector, and a female outlet assembly conductively coupled to the electrical cord. The male plug assembly includes a low-profile base sized to cover entirely a first female plug adapter and a second female plug adapter; a first male plug connector attached to and extending from the base and configured to engage with the first female plug adapter of the wall outlet; and a second male plug connector attached to and extending from the base and configured to engage with the second female plug adapter of the wall outlet. The female outlet assembly includes a housing; a female plug secured to the housing and conductively coupled to the cord; a light carried by the housing; and a switch secured to the housing and configured to activate the light.

6 Claims, 4 Drawing Sheets

SYSTEM FOR EXTENDING ELECTRICAL OUTLETS

BACKGROUND

1. Field of the Invention

The present invention relates generally extensions for electrical outlets.

2. Description of Related Art

Extensions for electrical outlets are well known in the art and are effective means to access electrical outlets that are located too far from an appliance or are otherwise difficult to reach. For example, FIGS. 1 and 2 depict a front and side view, respectively, of a conventional system 101 for extending an electrical outlet 103 having a male plug 105 and a female plug 107 connected by an electrical cord 109.

It should be understood that the system 101 can be used to enable access to difficult to reach electrical outlets 103 such as those located behind an obstacle 111 such as heavy furniture.

A common disadvantage associated with system 101 is that it is difficult to install when an obstacle 111 already blocks the electrical outlet 103. Often, the obstacle 111 must be permanently pulled further away from the electrical outlet 103 to make space for the system 101.

Another disadvantage commonly associated with system 101 is that its position is dictated by its proximity to the electrical outlet 103 and by gravity. The system 101 therefore, cannot on its own be adjusted for either functional or aesthetic purposes.

Although great strides have been made in the area of systems for extending electrical outlets, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
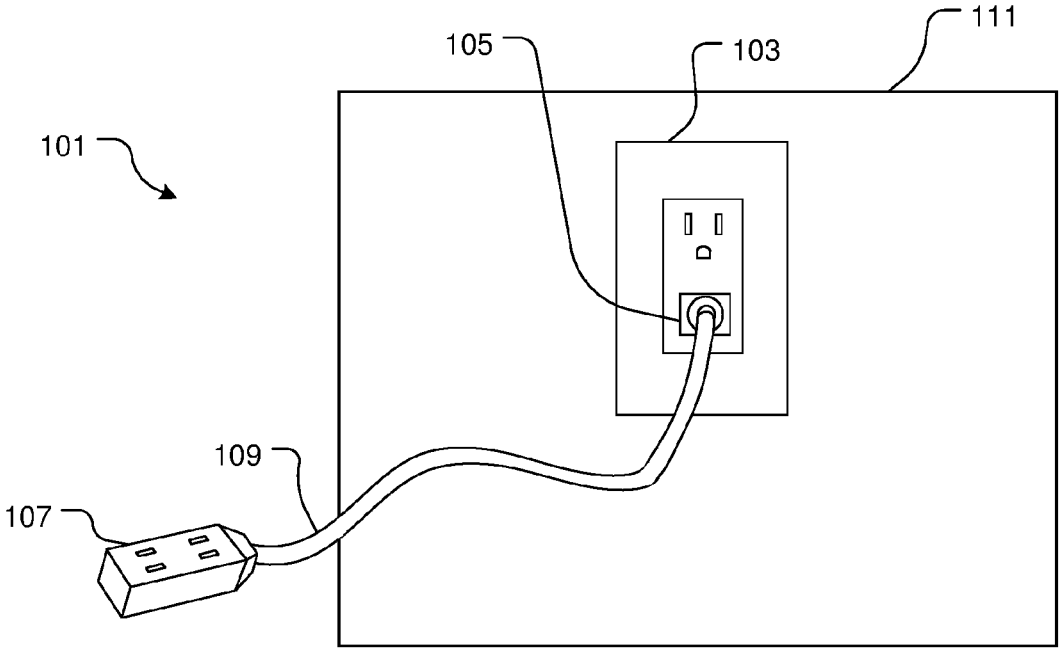
FIG. 1 (Prior Art)
FIG. 1 is a front view of a conventional system for extending electrical outlets.
Figure 2:
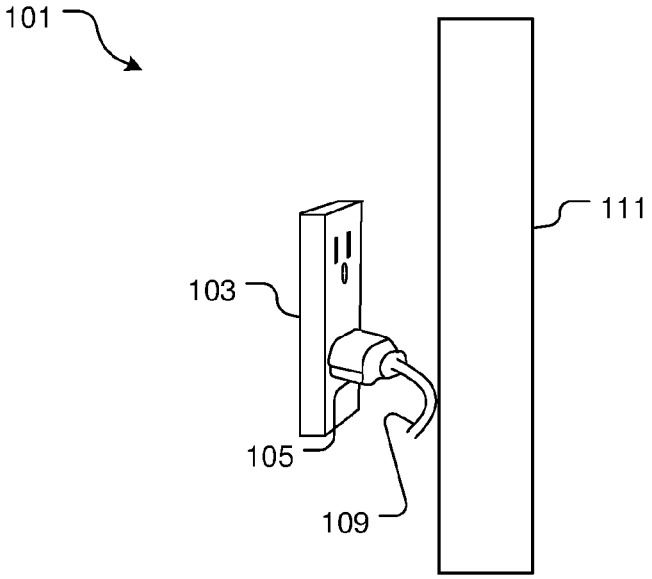
FIG. 2 (Prior Art)
FIG. 2 is a side view of the system of FIG. 1.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional systems for extending electrical outlets. Specifically, the system of the present application is configured to aesthetically enable easier access to an electrical outlet that is located behind an obstacle. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 3:
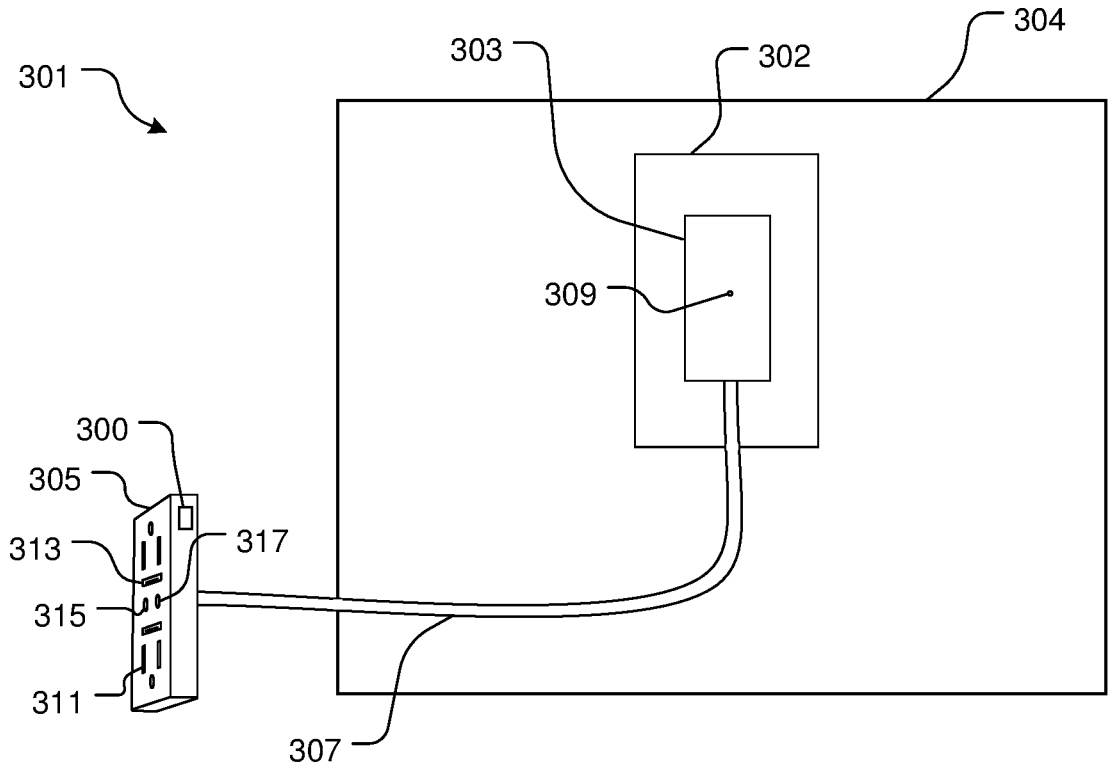
FIG. 3 is a front view of a system for extending electrical outlets in accordance with a preferred embodiment of the present application.
Figure 4:
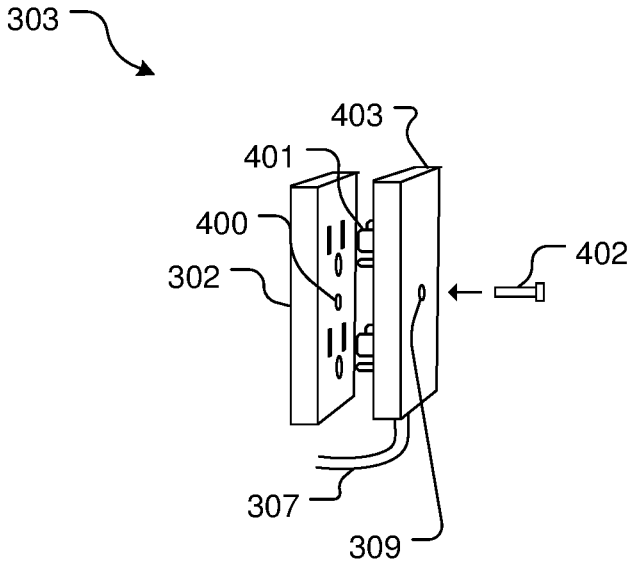
FIG. 4 is side view of the system of FIG. 3.

Referring now to the drawings wherein like reference characters identify corresponding or similar elements throughout the several views, FIGS. 3 and 4 depict a front view and a side view, respectively, of a system 301 for extending an electrical outlet in accordance with a preferred embodiment of the present application. It will be appreciated that the system 301 overcomes one or more of the above-listed problems commonly associated with conventional systems for extending an electrical outlet.

In the contemplated embodiment, system 301 includes a male plug assembly 303 and one or more female outlet assemblies 305 connected via an electrical cord 307. In one contemplated embodiment, the cord 307 could include elastically manipulated material configured to allow the cord to retain a desired direction and shape. This features allows better manipulation and positioning of the female outlet assembly during use.

As depicted in FIG. 4, the male plug assembly 303 includes a low-profile base 403 configured to secure to an electrical outlet 302 via one or more male plug connectors 401 and one or more fastening devices 309. In the preferred embodiment, the fastening device 309 is a hole that extends through the thickness of the base 403 and aligns with a hole of the electrical outlet 302. It is contemplated having a fastener 402 extend through hole 309 and to threadingly engage with hole 400, which in turn secures base 403 against the electrical outlet 302. Accordingly, the base 403 is secured in a fixed position against electrical outlet 302 via the male plug connectors and via fastener 402.

It will be appreciated that the low-profile male plug assembly 303 will facilitate installment of the system 301 and enable any obstacles 304 to be positioned closer to the electrical outlet 302 while the system 301 is installed.

In one contemplated embodiment, it will be appreciated that the one or more female outlet assemblies 305 can include one or more female plug connectors 311, one or more Universal Serial Bus, or USB, interfaces 313, a night-light 315, and a reading light 317 secured to a housing 400. The female outlet assembly could also include an electrical switch 300 that can be activated by sound, motion, or WiFi to activate the light and/or other electrical devices receiving power from connectors 311. It should be understood that the cord 307 could be composed of flexible material that retains a desired shape such that the user can manipulate the direction of the light 315 during use. For example, the user may wish to read a book in bed and could manipulate the cord direction and orientation such that the light illuminates the book while the user in the bed.

Figure 5:
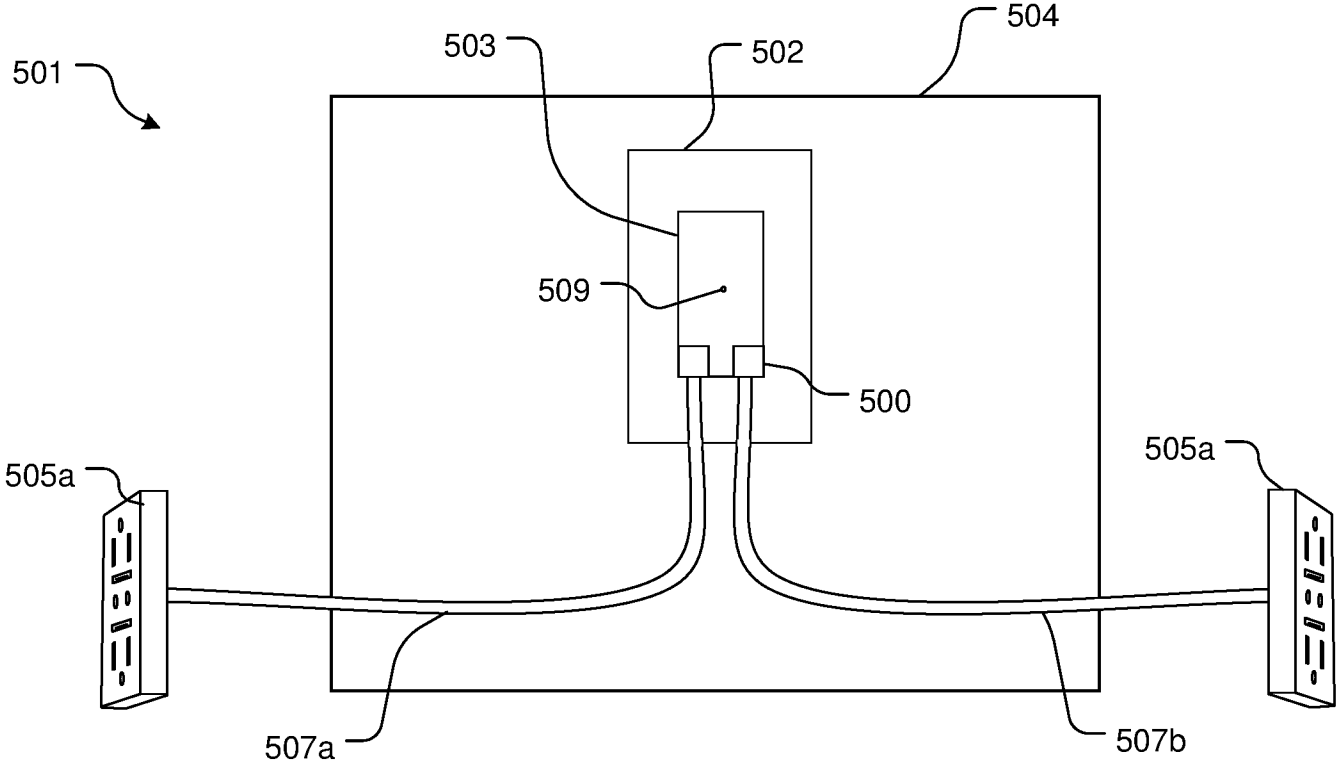
FIG. 5 is a front view of a system for extending electrical outlets in accordance with an alternative embodiment of the present application.

Referring now to FIG. 5 an alternative embodiment of system 301 is shown having at least two female outlet assemblies 505*a*, 505*b* connected to the male plug assembly 503 via respective cords 507*a*, 507*b*. As discussed above, the system 501 secures to an electrical outlet 502 via a male plug assembly 503 and one or more securing devices 509, even if the electrical outlet 502 is placed behind an obstacle 504. It is also contemplated that the female outlet assemblies 505 are secured to the one or more male plug assemblies 503 by a detachable devices 500.

Figure 6:
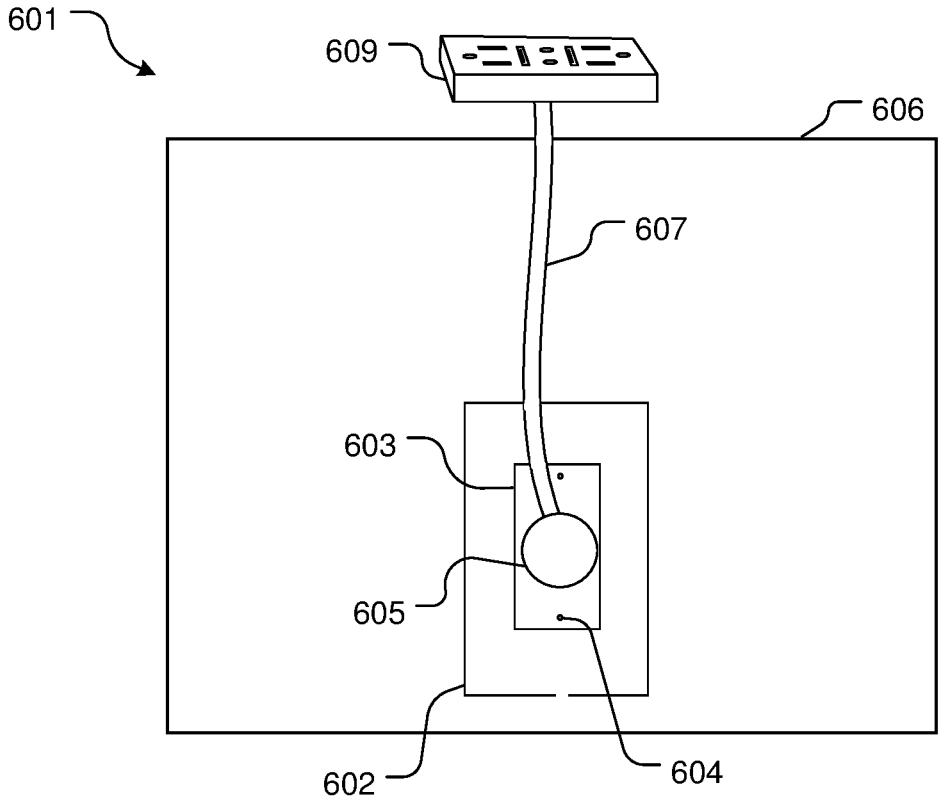
FIG. 6 is a front view of a system for extending electrical outlets in accordance with a second alternative embodiment of the present application.

Referring now to FIG. 6 an alternative embodiment of system 301 is shown including include a rotating means 605, secured to the male plug assembly 603 and fastening means 604, that enables the cord 607 and female outlet assembly 609 of the system 601 to rotate 360 degrees in respect to the electrical outlet 602. It will be appreciated that this feature will enable additional functional uses for the system 601 such as raising the height of the electrical outlet 602 beyond the reach of a child (not shown) or above an obstacle 606 rather, than merely around it.

One of the unique features believed characteristic of the present application is the ability to precisely adjust the system 301 for both functional and aesthetic purposes.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An electrical cord system comprising:

a female outlet assembly configured to engage with a wall outlet, the female outlet assembly comprising a pair of first female outlets, and a low-profile base sized to receive entirely a first male outlet adapter; the first male outlet adapter configured to connect the female outlet assembly; the first male outlet adapter comprising a pair of first male outlets;

a second female adapter configured to connect the first male outlet adapter by an electrical cord;

the second female adapter comprising a pair of second female outlets;

the second female adapter comprising a housing, a light carried by the housing; and a switch secured to the housing and configured to activate the light;

the pair of first male outlets of the first male outlet adapter are a first outlet connector and a second outlet connector; the first outlet connector and the second outlet connector are located on a same flat surface and both to be mating to the pair of first female outlets of the female outlet assembly at the same time, the first outlet connector and the second outlet connector are two different power lines.

2. The system of claim 1, the female outlet assembly further comprising:

a USB port secured to the housing and conductively coupled to the electrical cord.

3. The system of claim 1, wherein the electrical cord is composed of elastic material configured to retain a desired shape.

4. The system of claim 1, wherein the switch is wirelessly activated.

5. The system of claim 1, further comprising:

a fastening device configured to rigidly attach the base to the wall outlet.

6. The system of claim 5, the fastening device comprising:

a fastener configured to extend through a hole of the base and configured to threadedly attach to the wall outlet.

* * * * *